US005870524A

United States Patent [19]

Swiatosz

[11] Patent Number: 5,870,524

[45] Date of Patent: Feb. 9, 1999

[54] SMOKE GENERATOR METHOD AND APPARATUS

[76] Inventor: Edmund Swiatosz, 335 Lake Seminary Cir., Maitland, Fla. 32751

[21] Appl. No.: 787,265

[22] Filed: Jan. 24, 1997

[51] Int. Cl.[6] ..... A61H 33/06; F22B 29/06

[52] U.S. Cl. ..... 392/394; 392/397

[58] Field of Search ..... 392/379, 383, 392/384, 385, 386, 387, 394, 396, 397, 398, 400, 401

[56] References Cited

U.S. PATENT DOCUMENTS

| | | | |
|---|---|---|---|
| 4,309,159 | 1/1982 | Holic | 126/12 |
| 4,547,656 | 10/1985 | Swiatosz et al. | 392/397 |
| 4,558,196 | 12/1985 | Babasade | 392/396 |
| 4,568,820 | 2/1986 | Swiatosz | 392/397 |
| 4,626,278 | 12/1986 | Kenney et al. | 266/202 |
| 4,732,085 | 3/1988 | Gershenson et al. | 102/334 |
| 4,748,817 | 6/1988 | Oura et al. | 62/74 |
| 4,764,660 | 8/1988 | Swiatosz | 392/397 |
| 4,818,843 | 4/1989 | Swiatosz | 392/397 |

*Primary Examiner*—Mark H. Paschall
*Assistant Examiner*—Sam Paik
*Attorney, Agent, or Firm*—William M. Hobby, III

[57] ABSTRACT

A smoke generator apparatus and method are provided in which the apparatus has a pump connected to a source of liquid smoke agent and to an electrical resistance heating tube incorporated into an electrical circuit. The heating tube has a smoke outlet orifice and a temperature sensor located adjacent the orifice. A switch control circuit has a connection to the temperature sensor and controls the start-up and shut-down operation of the smoke generator by the activation of the pump, electrical resistance heating tube, and the turning on and off of a fluid injector circuit and an air blower for cooling the heater tube. The fluid injector has a source of fluid connected to the heater tube adjacent the orifice and has a valve for activating the flow of fluid from the source of fluid into the heater tube during start-up and shut-down of the smoke generator. The method includes selecting the smoke generating apparatus, switching on the apparatus to activate the gas injector to inject gas into one end of the heater tube and to activate the pump to pump a liquid smoke agent into the heater tube to generator smoke. The air blower activated to cool down the heater tube at shut-down and the fluid injector again injects a fluid, such as a nitrogen gas, into the heater tube at shut-down.

12 Claims, 2 Drawing Sheets

SMOKE GENERATOR METHOD AND APPARATUS

BACKGROUND OF THE INVENTION

The present invention relates to a smoke generator apparatus and method and especially to the generation of smoke using an electrical resistance heating tube smoke generator.

Although there are a variety of types of smoke generators, only one system is available for firefighter trainers with a flame environment. This system uses a synthetic oil, such as Fyrquel 220 made by AKZO Chemical, Inc., which is the only smoke agent material considered acceptable by the Navy for their fire fighting trainers and more recently for civilian fire fighting trainers. These trainers utilize propane burners which are essentially smoke free and hence have a need for a supplemental machine made smoke for realistic fire fighting training conditions. Another use for high temperature resistance smoke is for periodic leak testing of steam boiler systems that utilize high temperature pressure vessels and piping where cool-down for leak testing is cost prohibitive and can be avoided by using high temperature smoke. So far, smoke agent fluid, such as Fyrquel 220, is the only material considered acceptable for these applications due to its high temperature resistance properties and low toxicity.

This smoke agent fluid, however, requires special design considerations and cannot be used with existing conventional low temperature (500° F. or lower) smoke generators. The reasons are not only the high operating temperatures (1000° F.), but also the tendency of the heated fluid to decompose with high temperature resident heating time, the time that the smoke agent fluid is in contact with heater surface, or the time that an element of fluid is at high temperature, is exceeded and when the heated smoke agent material is exposed to moisture or moist air at high temperatures, such as about 200° F. Hence, it is necessary to avoid or sufficiently minimize stagnant non-flow conditions at high temperatures in start-up and cool-down (shut-off) conditions. The smoke agent fluid is particularly susceptible to moisture contamination during cool-down since the heater tube (or boiling chamber) can have a negative pressure permitting moist air to enter the heating coil.

Only one existing smoke generator is currently able to avoid both high temperature residence time effects and high temperature moisture contamination. This is accomplished by forcing superheated air through a nozzle and then injecting the smoke agent fluid into this high velocity air stream. This method avoids the decomposition/clogging problem but it is expensive due to the high cost of heating and then discarding the air heat source and due to the need for a high pressure air blower. Such a system has a low heating efficiency due to wasted heat of the hot air medium as it exits from the outlet orifice with the smoke generating vapors. This exiting high temperature also tends to interfere with the condensation process required for an effective smoke output.

The conventional "low temperature" smoke generators are not amenable to the use of high temperature smoke agent due to their lengthy warm-up and cool-down times which presents residence heating problems. Another type of smoke generator utilizes a thin wall tube as an electrical resistance heater and has been used successfully for low temperatures of under 550° F. for non-flammable environments. One version of this type of smoke generator requires expensive temperature control considerations due to the low heater mass and long tube length. Either a special fast responding temperature controller that senses resistance changes with temperature distribution along the tube length or a special heat conductive, electrically non-conductive coating is required which permits the use of a point source temperature sensor. The coating, however, also increases the start-up heating time and shut-down cooling time. These two approaches preclude their use as a high temperature smoke generator due to the excessive high temperature residence time during transient start-up and/or shut-down and high temperature moisture contamination during cool-down.

A smoke generator suitable for low temperature smoke generation can be seen in my prior U.S. Pat. No. 4,818,843. This prior smoke generator utilizes a thin wall tube as an electrical resistance heater and utilizes a thin coating over the resistance heating tube which electrically isolates the coils of the coil electrical resistance heating tube while conducting heat through the coils from the hot to the cold end of the coiled electrical resistance heating tube. Other smoke generators can be seen in applicant's U.S. Pat. Nos. 4,547,656 and 4,568,820.

The present invention utilizes a resistance tube heater with a combination of gas injection at the nozzle outlet which atomizes the liquid output during start-up and provides rapid nozzle cooling at shut-down and (2) a high velocity air blower during shut-down for rapid heater cool-down time. This approach permits a continuous pump flow at all phases of operations and cool-down and thus avoids the occurrence of the dangerous hot liquid spray during start-up and lower resident heating time. Thus, the destructive effect of chemical decomposition due to the stagnant type heating is avoided since excessive pump delay as a method of preheating the smoke agent to avoid hot liquid spray would not be required. Also avoided is the stagnant heating of "empty" coils with smoke agent liquid residue coated heater surfaces which tends to breakdown the stagnant layer of liquid agent and eventual clogging of the heater coil.

SUMMARY OF THE INVENTION

A smoke generator apparatus and method are provided in which the apparatus has a pump connected to a source of liquid smoke agent and to an electrical resistance heating tube incorporated into an electrical circuit. The heating tube has a smoke outlet orifice and a temperature sensor located adjacent the orifice. A switch control circuit has a connection to the temperature sensor and controls the start-up and shut-down operation of the smoke generator by the activation of the pump, electrical resistance heating tube, and the turning on and off of a fluid injector circuit and an air blower for cooling the heater tube. The fluid injector has a source of fluid connected to the heater tube adjacent the orifice and has a valve for activating the flow of fluid from the source of fluid into the heater tube during start-up and shut-down of the smoke generator. The method includes selecting the smoke generating apparatus, switching on the apparatus to activate the gas injector to inject gas into one end of the heater tube and to activate the pump to pump a liquid smoke agent into the heater tube to generator smoke. The air blower activated to cool down the heater tube at shut-down and the fluid injector again injects a fluid, such as a nitrogen gas, into the heater tube at shut-down.

BRIEF DESCRIPTION OF THE DRAWINGS

Other objects, features, and advantages of the present invention will be apparent from the written description and the drawings in which.

DESCRIPTION OF THE PREFERRED EMBODIMENT

The present invention utilizes the advantages of a large heat transfer area and low thermal mass of a heater tube as an improved method for using a high temperature smoke agent. This is accomplished by taking into consideration the thermal characteristics of the smoke agent material and the operational performance required for chemical stability of the smoke agent during all phases of operation.

Figure 1:
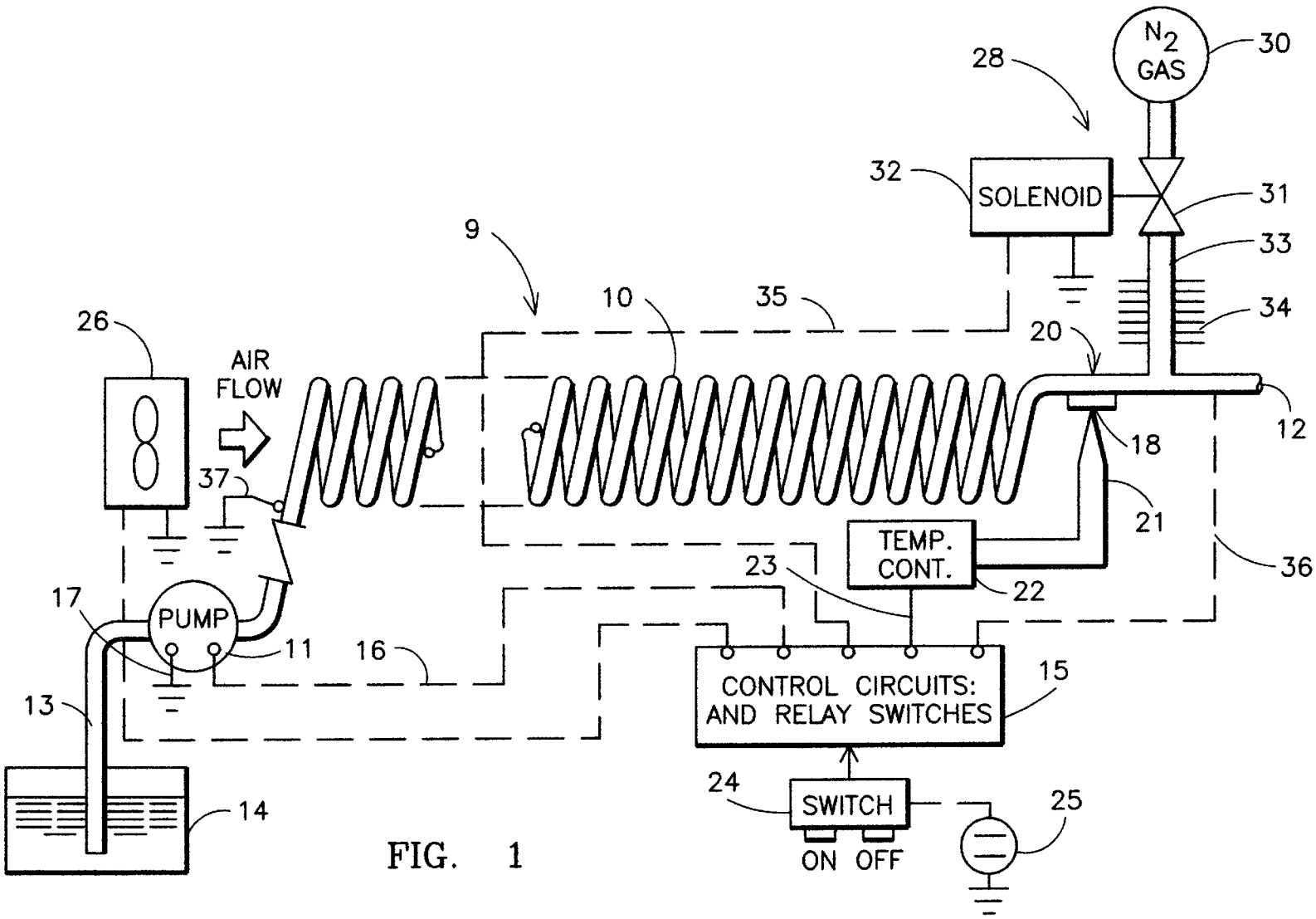
FIG. 1 is a schematic drawing of a smoke generator in accordance with the present invention.
Figure 2:
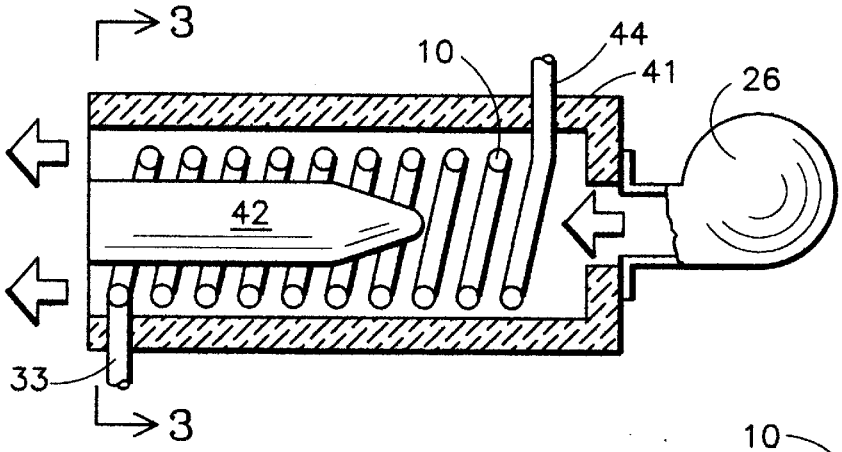
FIG. 2 is a sectional view taken through the electric heater tube and blower assembly.
Figure 3:
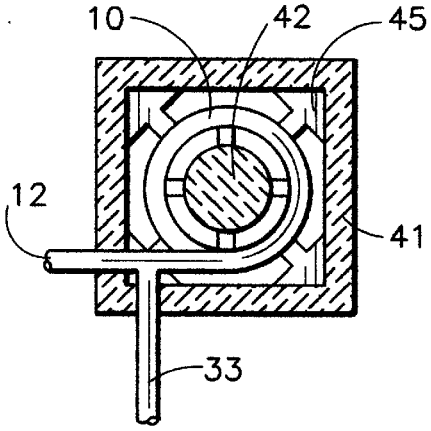
FIG. 3 is a sectional view taken on the line 3—3 of FIG. 2.

Referring to FIGS. 1–3 of the drawings and especially to FIG. 1, an electrical resistance heater tube 10 is shown as a heating coil connected at one end to an electrical pump 11 and having an orifice outlet 12 at the other end thereof. Heater tube 10 is an Inconel alloy but can also be made of stainless steel or other metal as desired. The pump 11 is connected by a tube 13 to a liquid smoke agent source 14. The pump is also connected from a control or switch circuit 15 through an electrical conductor 16 and to a ground 17 so that the pump can be actuated by the circuit 15. A heater tube 10 has a temperature sensor 18 connected to the end portion 20 of the tube 10 adjacent the orifice 12. Sensor 18 is connected by electrical conductors 21 to a temperature controller 22 which in turn is connected through a conductor 23 to the control circuit 15. An on/off switch 24 is connected to a power source 25 and to the control circuit 15 for providing power to the smoke generator when in the "ON" position. An air blower 26 is positioned to blow air onto and over the heater tube coil 10 and is connected through an electrical conductor 27 to the control circuit 15.

A fluid injector circuit 28 includes a source or container of fluid 30, such as compressed nitrogen gas connected through a solenoid actuated valve 31, actuated by the solenoid 32, and through a tube 33. Tube 34 has a heat exchanger thereon and connects into the end portion 20 of the heater tube 10 adjacent the orifice 12. The solenoid 32 is connected by a conductor 35 to the control circuit 15. The heater tube 10 forms a resistance in an electrical circuit when connected between a conductor 36 which connects the control circuit to the end portion 20 of the heater tube 10. The heater tube 10 is connected to ground at 37 so that when electric current is applied through the tube 10, the tube is heated by the resistance in the tube to heat the tube. A liquid being pumped through the tube 10 from the pump 11 is vaporized to form the smoke out the orifice 12. The fluid injection circuit 28 is used during the start-up and cool-down periods while the electrical resistance heater tube 10 is being heated up and cooled down. The blower 26 is used only during the cool-down of the heater tube 10 to allow the use of a high temperature smoke agent in the smoke generator 9.

In FIG. 2, the heater and blower assembly 40 has the heater tube 10 incorporated inside a housing 41 having the blower 26 attached to the end thereof and utilizing a ceramic spacer 42 positioned within the coil of the heating tube 10. The ceramic cylindrical spacer 42 has a cone shaped end 43 and deflects the air from the blower 26 passing over the coils 10 and forces the air therearound to form a venturi to increase the velocity of the air passing the coils 10 wrapped around the ceramic spacer 42. The inlet 44 of the tube receives the liquid 14 from the inlet pump and the gas injection inlet tube 33 forcing the gas into the end portion 20 of the tube 10 when activated. Ceramic spacer supports 45, as seen in FIG. 3, supports the ceramic spacer 42 in position inside the coiled heating tube 10.

A special feature of the package is to provide for cooling air from blower 26 to pass over the heating coil 10 at high velocity during the shut-down phase after smoke generation. To facilitate the high air velocity, the ceramic cylindrical spacer 42 is inserted into the "hot" end of the heater coil. This provides a reduced cross-sectional air flow area to match the air blower outlet duct area to maintain the high velocity over the heater coil 10 surfaces.

The electrical resistance heater tube 10 may use an ⅛ inch outside diameter tube of ×0.007 inch wall thickness approximately 30 feet long and made of Inconel metal alloy. This material provides high temperature capability and electrical resistivity properties for a 7 ohm resistance and 1700 watts of heating power at 120 volts. Any tube size and material desired can of course be used without departing from the spirit and scope of the invention. The tube may be formed into an approximate 0.3 inch diameter coil of 9 inches length and packaged in a ceramic insulation.

Operation of the system as seen in FIG. 1 is initiated by pressing the momentary "on" button on switch 24 that closes the appropriate relay in the control circuit 15 to start heating the electrical tubular resistance heater 10. At the same time, the pump 11 is activated to start feeding the liquid smoke agent fluid from the reservoir 14 to the heater tube 10. At the same time, the solenoid valve 31 is opened and pressured gas, such as 50 psi of nitrogen or air, is injected into the nozzle 20 just before the outlet orifice 12. Thus, the "cold" smoke agent liquid is atomized into a fine mist at the initial start-up to avoid a concentrated liquid stream. The gas injection is continued as the smoke agent heats up within the heater coil 10 to a saturated then to a superheated (700°–1000° F.) vapor after approximately one minute. At this point, the gas valve 31 is shut off as a steady-state smoke operation is reached and maintained by the thermocouple temperature sensor 18 in conjunction with a temperature controller 22. During this phase of operation, the heat exchanger 34 prevents excessive heat conduction to the solenoid valve 31. As the superheated vapors exit out the orifice 12, the vapors are cooled by the outside open air and condense into smoke particulate. When the system is ready for shut-down, the momentary off button located on switch 24 is pushed to shut off the heating power while the pump continues to operate. At the same time, the cooling blower 26 is activated and the solenoid valve 31 is opened to again inject nitrogen gas into the outlet nozzle for cooling the nozzle. The combined cooling effect of the pump and the cooling fan 26 produces a rapid cooling of the heater coil 10 to avoid stagnant heating of the smoke agent liquid 14. After approximately 30 seconds, the temperature of the heater coil will be about 150° F. and the previously vapor filled section of the heater coil will continue to be filled with fluid. At this point, the injected gas will be shut off but the pump 11 and air blower 26 will continue to operate. The pump 11 is shut off after the heater is filled with smoke agent liquid 14 and the air blower 26 continues for a total time of about 10 minutes. Hence, the effective cooling of the high velocity air blower 26 will preclude the need for additional liquid pumping for cooling purposes.

Thermal breakdown of the smoke agent material does not occur during steady state operation. This means that the residence time, or the time at which the fluid is at high temperature, is sufficiently short enough to avoid thermal decomposition during steady-state operation.

During start-up, provisions for temperature and moisture control are required. Since the heated vapor at the orifice 12 end of the tube 20 occupies about one-third of the total volume of the heater tube 10 during steady-state operation, then this section is empty if the heater tube 10 is shut-down under these conditions. Hence, the heater tube 10 would normally be susceptible to moisture intrusion through the outlet orifice 12 during cool-down between operations. Moreover, the liquid coating of the inside of the tube wall is subject to stagnant heating upon subsequent start-up and susceptible to thermal breakdown/decomposition. This is because under normal conditions, the pump 11 would be delayed after initial heater start-up to allow the temperature to increase sufficiently high enough, approximately 700° F., in order to avoid hot fluid ejecting out the orifice before the dry smoke is developed. Therefore, the heater coil 10 is kept full of liquid at all times while avoiding the hazard of hot liquid ejection during start-up. This is accomplished by injecting a dry gas, such as nitrogen, into the outlet nozzle 20 during start-up to atomize the liquid as it exists out the orifice 12. This has the effect of spreading out the heat of the liquid throughout the outside air to form a much cooler mist flowing from the outlet orifice 12. As the smoke agent 14 in the heater 10 becomes sufficiently hot enough to become a superheated vapor, the injected gas is no longer needed and is shut off as steady state smoke is being generated.

During shut-down after steady-state operation, the electrical heater 10 is shut off and a high air velocity cooling blower 26 is turned on while liquid pump flow is continued. Hence, the flowing liquid avoids stagnant residence time heat effects of the smoke agent within the heater tube 10. The pump flow also provides additional cool liquid to accelerate the cooling process. At the same time, gas is again injected just before the outlet orifice 12 to facilitate rapid cooling of the outlet nozzle 20. Residue vapors within the heater coil 10 continue to be ejected out the orifice as it mixes with the injected gas. Eventually, the pumped liquid will fill the entire coil 10 and, at this point, the pump 11 and the injected gas are shut off. The preceding process takes place in about 30 seconds and the heater temperature at this point is about 150° F. which is low enough for the pump 11 to be shut off and avoid stagnant heating decomposition breakdown. The cooling fan 26 operation is continued until the heater coil 10 is near room temperature after about 10 minutes from heater shut off. The gas injector 28 permits an option for additional liquid cooling pump flow for still faster cool down and shorter cooling fan operation. Since the entire heater coil 10 is filled with smoke agent liquid 14 after the cool-down, then it will still be filled in between start-up operations. Hence, an empty section of the heater coil 10 is avoided which prevents exposure to moisture contamination and stagnant heating of liquid coated surfaces inside an empty section of the heater tube 10 at the subsequent start-up.

An optional mode of operation is to have a continuous gas injection from the gas injection circuit 28 during all phases of operation. Smoke generation during steady-state without gas injection would depend on the superheated temperature and pressure to produce the desired smoke particle size and cloud characteristics. Injecting the gas at the outlet nozzle at selected temperatures produces a mechanical shearing effect on the hot reduced viscosity liquid to control the smoke particle size. Lower temperatures are thus possible as a trade off for more gas usage.

Figure 4:
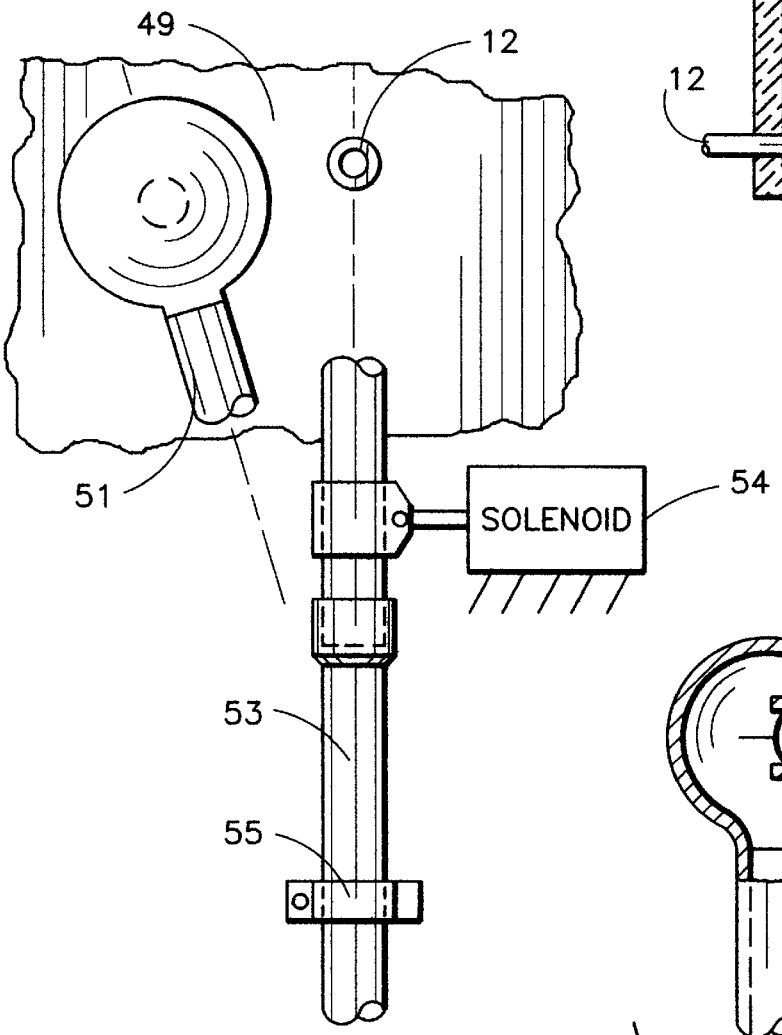
FIG. 4 is a partial front elevation of an alternate embodiment of a drain for the heater tube.
Figure 5:
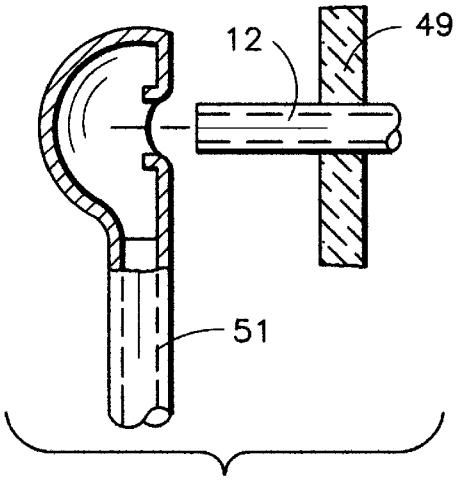
FIG. 5 is a sectional view of the embodiment of FIG. 4.

In lieu of or in addition to the gas injection subsystem 28, an alternative method of handling the hot liquid at start-up is presented in FIGS. 4 and 5. This alternative method system is used as a trade-off to avoid a gas supply system and a spray mist start-up operation. A metal drain tube collector 51 is in line with the outlet orifice 12 when the smoke generator is first started. As the liquid smoke agent is heated and saturated, vapors start to expand the liquid, a hot liquid jet will exit out the orifice 12 into the metal collector 51 and against deflector trap 52 and proceed to the drain tube 53. After about 30 seconds, the temperature of the smoke agent will continue to increase and hot vapors will exit out the orifice and condense into a fine smoke at the outlet orifice 12. The solenoid 54 is energized to displace the metal tube collector to position, as shown in FIG. 4, out of alignment with the outlet orifice 12. This movement is possible due to the flexible tube 53 and the rotation about the pivot point at the clamp 55. After the smoke generation operation is ended, the metal tube collector 51 is returned to the in-line position and is ready for the next start-up operation.

This embodiment essentially requires the same method of operation as the invention presented herein with the gas injection except that the signal that is used to operate the gas solenoid 32 is used to operate the tube collector solenoid 54. Materials, such as stainless steel, for the tube collector 51 and TEFLON for the flexible tube 53 may be selected to withstand the high temperatures, although other appropriate materials may also be available. Placement of the tube in an in-line position in the cooling air stream or adding extended cooling surfaces to the metal tube collector can be used if the selected smoke generating capacity requires it. This collector/deflector mode of operation permits an optional operation when the initial fog spray start-up is not desired to avoid residue problems. This feature however results in decomposition of the hot liquid coating on the collector due to stagnant heating and moisture effects. Hence, there is a trade-off for increase in maintenance cleanup for the collector approach, whereas the airjet operational mode would avoid this additional maintenance.

It should be clear at this time that a non-flammable high temperature smoke generator apparatus and method of operation have been provided utilizing a high temperature smoke agent. However, the present invention is not to be construed as limited to the forms shown which are to be considered illustrative rather than restrictive.

I claim:

1. A smoke generator comprising:

an electrical power source;

an electric pump connected to said electrical power source and to a liquid source;

an electrical resistance heating tube having two end portions and forming an electrical resistance in an electrical circuit, said heating tube being connected at one end portion thereof to said pump for receiving a liquid pumped therefrom, and said heating tube having a smoke outlet orifice in the other end portion thereof;

a temperature sensor located adjacent said other end of said heating tube for sensing the temperature at said other end portion of said heating tube;

a fluid injection circuit having a source of fluid connected to the other said end portion of said electrical resistance heating tube, said fluid injection circuit having an electric valve therein for activating the flow of fluid from said source of fluid into said other end portion of said electrical resistance heating tube;

a switch circuit connected to said temperature sensor and to said fluid injection circuit electric valve for activating said electric valve to thereby inject a fluid from said fluid source into said electrical resistance heating tube; and an air blower connected to said switch circuit and positioned to blow air on said electrical resistance heating tube when said heating tube is being cooled down; whereby smoke is generated by heating a liquid in a heating tube and is discharged therefrom.

2. A smoke generator in accordance with claim 1 in which said switch circuit includes a delay circuit to delay activating said pump for a predetermined period after activating said smoke generator.

3. A smoke generator in accordance with claim 1 in which said fluid injection circuit source of fluid includes a pressurized gas.

4. A smoke generator in accordance with claim 3 in which said fluid injector circuit valve is an electrically actuated solenoid valve.

5. A smoke generator in accordance with claim 4 in which said electrical resistance heating tube includes a coiled Inconel tube.

6. A smoke generator in accordance with claim 4 including an on/off switch for activating said electrical resistance heating tube and said temperature sensor.

7. A smoke generator in accordance with claim 3 in which said fluid injection circuit pressured gas is pressurized nitrogen.

8. A smoke generator in accordance with claim 6 in which said fluid injection circuit includes a heat exchanger.

9. A method of generating smoke comprising the steps of:

selecting a smoke generating apparatus having a pump connected to a source of liquid smoke agent and to a heating tube forming an electrical resistance in an electrical circuit, and said heating tube having a smoke outlet orifice, and having a temperature sensor located adjacent said heating tube orifice and a switch circuit connected to said temperature sensor and to said pump for activating said pump to pump a liquid smoke agent into said heating tube, said smoke generating apparatus also having a gas injector having a source of fluid connected to said heating tube adjacent the orifice therefrom, said gas injector including a valve for activating the flow of fluid from said source of fluid into said heating tube;

switching on said electrical heating tube and temperature sensor;

activating said gas injector to inject a gas into one end of said heating tube upon startup of said electrical heating tube;

activating said pump to pump a liquid smoke agent into said heating tube to produce smoke out said heating tube orifice from said liquid smoke agent; and activating an electric blower to blow air over said heating tube upon turning off said heating tube.

10. A method of generating smoke in accordance with claim 9 including the step of activating said gas injector to inject a gas into one end of said heating tube upon turning off said electrical heating tube.

11. A method of generating smoke in accordance with claim 9 including the step of sensing the temperature in said heating tube to determined startup and shut-down conditions for activating said gas injector responsive to sensing predetermined temperatures.

12. A method of generating smoke in accordance with claim 11 in which the step of activating said gas injector to inject a gas into one end of said heating tube injects nitrogen into said heating tube.

* * * * *